US010976138B2

(12) United States Patent
Tervola et al.

(10) Patent No.: US 10,976,138 B2
(45) Date of Patent: Apr. 13, 2021

(54) MODULAR, COLLAPSIBLE, AND PORTABLE BALLISTIC SHIELD SYSTEM

(71) Applicant: Tactical Revolution, LLC, Jupiter, FL (US)

(72) Inventors: Timo Olavi Tervola, Palm Beach Gardens, FL (US); Sean Richard Rosario, Parkland, FL (US); Gerald David Benjamin, Jupiter, FL (US)

(73) Assignee: TACTICAL REVOLUTION, LLC, Jupiter, FL (US)

( * ) Notice: Subject to any disclaimer, the term of this patent is extended or adjusted under 35 U.S.C. 154(b) by 0 days.

(21) Appl. No.: 16/450,578

(22) Filed: Jun. 24, 2019

(65) Prior Publication Data

US 2020/0064106 A1 Feb. 27, 2020

Related U.S. Application Data

(63) Continuation-in-part of application No. PCT/IB2017/058386, filed on Dec. 22, 2017.

(60) Provisional application No. 62/437,808, filed on Dec. 22, 2016.

(51) Int. Cl.
*F41H 5/08* (2006.01)

(52) U.S. Cl.
CPC ..... *F41H 5/08* (2013.01)

(58) Field of Classification Search
CPC ..... F41H 5/08; F41H 5/06
USPC ..... 89/36.01, 36.02, 36.05, 36.07
See application file for complete search history.

(56) References Cited

U.S. PATENT DOCUMENTS

| | | | | | |
|---|---|---|---|---|---|
| 2,020,702 | A * | 11/1935 | Russell | F41H 5/08 | 2/2.5 |
| 3,370,302 | A * | 2/1968 | Karlyn | F41H 5/08 | 2/2.5 |
| 3,745,938 | A * | 7/1973 | Hathaway | F41H 5/08 | 109/49.5 |
| 5,056,155 | A * | 10/1991 | Truxell | F41H 5/08 | 109/49.5 |
| 5,241,703 | A * | 9/1993 | Roberts | F41H 5/08 | 109/49.5 |
| 6,807,890 | B1 * | 10/2004 | Fuqua | F41H 5/08 | 89/36.02 |
| 8,015,910 | B1 * | 9/2011 | Fuqua | F41H 5/14 | 89/36.01 |
| 8,210,088 | B1 * | 7/2012 | Keyfauver | F41H 5/08 | 89/36.05 |

(Continued)

*Primary Examiner* — Joshua E Freeman

(57) ABSTRACT

A collapsible ballistic shield which provides a degree of protection against ballistic threats. The shield includes a head plate, an upper torso plate, a lower torso plate, an upper lock-and-release hinge joint, a lower lock-and-release hinge joint, a primary handle, and a strap-mounting fastener. The head plate is positioned opposite to the lower torso plate, across the upper torso plate to outline a shape of a body. The head plate is pivotably attached to the upper torso plate by the upper lock-and-release hinge joint. The lower torso plate is pivotably attached to the upper torso plate by the lower lock-and-release hinge joint. Resultantly, the shield may be collapsed, expanded, and broken down. The primary handle provides a grasping point and is mounted to a rear surface of the upper torso plate. The strap-mounting fastener allows the user to attach the shield to external structures.

15 Claims, 9 Drawing Sheets

(56) References Cited

U.S. PATENT DOCUMENTS

| | | | | |
|---|---|---|---|---|
| 8,418,595 | B1 * | 4/2013 | Saucedo | F41H 5/26 89/36.01 |
| 8,584,571 | B2 * | 11/2013 | Armellino, Jr. | F41H 5/08 89/36.01 |
| 2002/0092416 | A1 * | 7/2002 | Cohen | F41H 5/06 89/36.05 |
| 2003/0110933 | A1 * | 6/2003 | Baker | F41H 5/08 89/36.05 |
| 2005/0217472 | A1 * | 10/2005 | Baker | F41H 5/08 89/36.06 |
| 2007/0125224 | A1 * | 6/2007 | Thomas | F41H 13/0087 89/36.07 |
| 2007/0283477 | A1 * | 12/2007 | Dovner | F41H 9/10 2/2.5 |
| 2015/0292840 | A1 * | 10/2015 | Tobin | F41H 5/08 89/36.07 |
| 2016/0054101 | A1 * | 2/2016 | Rashad | F41H 5/08 109/23 |
| 2018/0073841 | A1 * | 3/2018 | DeKort | F41H 5/24 |

* cited by examiner

MODULAR, COLLAPSIBLE, AND PORTABLE BALLISTIC SHIELD SYSTEM

The current application is a continuation-in-part (CIP) application of the Patent Cooperation Treaty (PCT) application PCT/IB 2017/058386 filed on Dec. 22, 2017. The PCT application PCT/IB 2017/058386 claims a priority to the U.S. Provisional Patent application Ser. No. 62/437,808 filed on Dec. 22, 2016.

FIELD OF THE INVENTION

The present invention relates generally to the field of defensive equipment. More specifically, the present invention is a collapsible ballistic shield.

BACKGROUND OF THE INVENTION

When faced with the possibility of being fired upon by one or more individuals equipped with a firearm, law enforcement, military, and other security personnel may want to use portable ballistic shields to provide themselves with a degree of protection against such threats. However, while the benefits of using a shield may be obvious, existing shield technologies and the way in which they are employed may also have their shortcomings, which may either restrict their use or otherwise handicap the user during their use.

Conventional shields may vary in shape, size and ballistic rating but they generally consist of a single piece of rigid armor material with a handle affixed to it. Additionally, conventional shields tend to be cumbersome to transport without a vehicle, and in situations where it's necessary to hike long distances over rough terrain, parachute in from an airplane, swim or dive to a location, bringing a conventional shield to the location may not be possible. Furthermore, the usefulness of a shield of a given shape and size may vary from one scenario to another. For instance, a large shield may be suitable for clearing the spacious areas of an airport, but it may not be possible to use the same large shield within an airplane due to tight spacing. These types of limitations may result in personnel having to execute an operation, or certain aspects of an operation, without the added protection of a shield when it may have otherwise been desired.

In addition, the typical method of using a conventional shield may involve an individual carrying said shield with a single hand and holding it up to their face and torso for protection. This may be physically taxing on their arms, especially with heavier shields or prolonged periods of use, and it may also hinder the user's ability to simultaneously use a firearm effectively. Resultantly, there is a need for a portable ballistic shield system. The present invention provides a collapsible and highly portable ballistic shield. In particular, this is accomplished by dividing the shield into two or more armored sections that are releasably coupled together with innovative mounts, thus allowing the shield to be collapsed or broken down into smaller sections for transport. This design also provides versatility by enabling the shield system to be configured into various shapes and sizes based on operational needs, even during an ongoing operation. Furthermore, the present invention provides a means for effectively using a firearm while being protected by the present invention.

DETAIL DESCRIPTIONS OF THE INVENTION

All illustrations of the drawings are for the purpose of describing selected versions of the present invention and are not intended to limit the scope of the present invention.

The present invention generally relates to defensive equipment. More specifically, the present invention is a portable ballistic shield that is scalable, collapsible, and modular. Resultantly, the present invention may be utilized in a variety of ways, such as a hands-free shield, in a vertical orientation, and in a horizontal orientation to name a few non-limiting examples. Resultantly, the present invention permits a user to carry/utilize the present invention while simultaneously carrying/using either a primary or secondary firearm.

Figure 1:
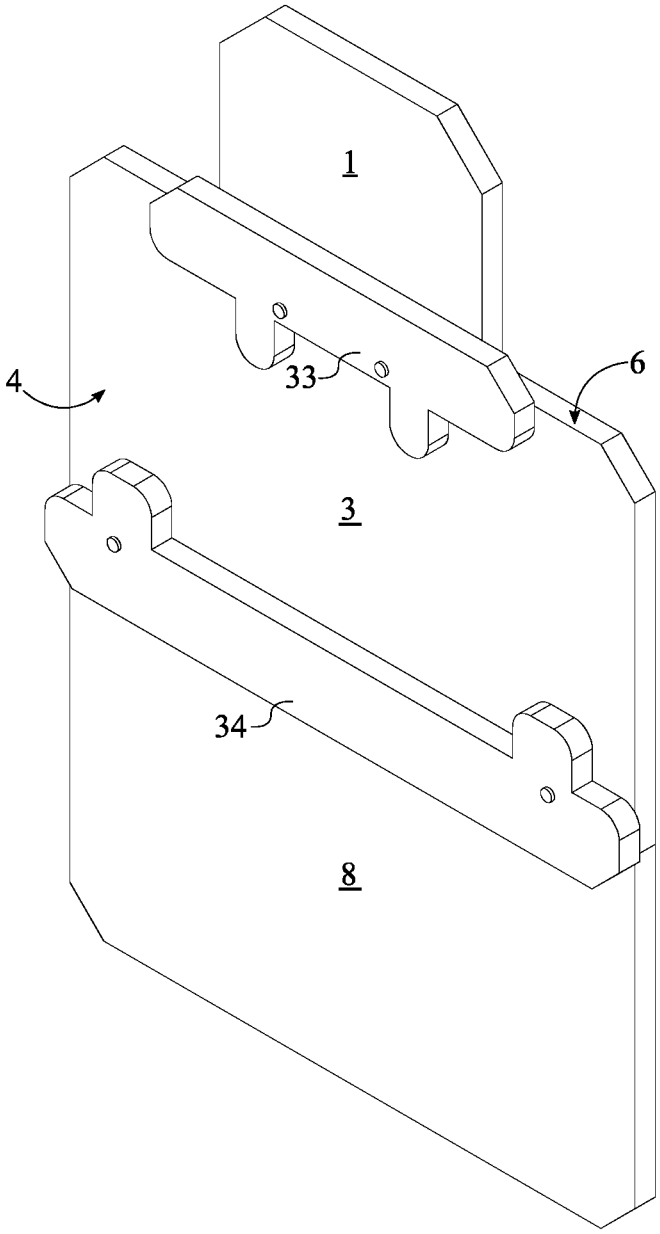
FIG. 1 is a perspective view of the present invention.
Figure 2:
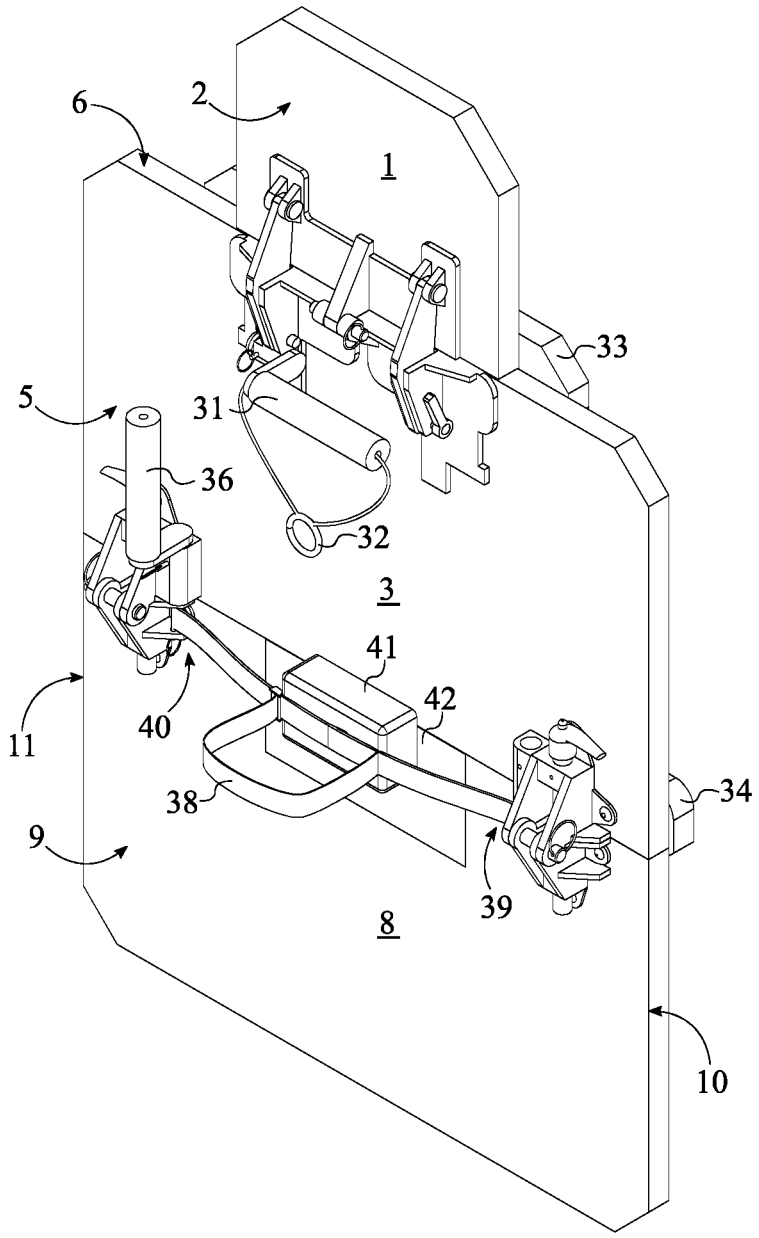
FIG. 2 is a rear-perspective view of the present invention.

Referring to FIG. 1 and FIG. 2, the present invention comprises a head plate 1, an upper torso plate 3, a lower torso plate 8, an upper lock-and-release hinge joint 12, an at least one lower lock-and-release hinge joint 23, a primary handle 31, and a strap-mounting fastener 32. The head plate 1, the upper torso plate 3, and the lower torso plate 8 make up a defensive armor shield which protects or defends the user against gunfire and other similar dangers. More specifically, the head plate 1, the upper torso plate 3, and the lower torso plate 8 are each preferably a rectangular plate composed of ultra-high-molecular-weight polyethylene. The head plate 1 is designed to protect the head and neck portion of the user. For adequate protection, the width and height of the head plate 1 is preferably similar to the height and width of the user's head. The upper torso plate 3 is designed to protect the midsection of the user, the torso specifically. For adequate protection, the width and height of the upper torso plate 3 is preferably similar to the height and width of the user's torso or midsection. The lower torso plate 8 is designed to protect the lower portion of the user, such as the waist, the genitals, legs, and the feet. For adequate protection, the width and height of the lower torso plate 8 is preferably similar to the height and width of the user's lower section, the waist and the legs. The head plate 1, the upper torso plate 3, and the lower torso plate 8 are oriented parallel to each other to yield a single planar structure. In particular, the head plate 1 and the lower torso plate 8 are positioned opposite to each other along the upper torso plate 3 to outline the profile/silhouette of a human body. The width and height of the head plate 1, the upper torso plate 3, and the lower torso plate 8 may vary to accommodate a variety of body sizes and user preferences. In the preferred embodiment of the present invention, the width of the head plate 1 may be less than the width of the upper torso in order to allow the user to use a rest a rifle on the upper torso plate 3 and utilize the rifle in a practical manner while employing the present invention.

Figure 8:
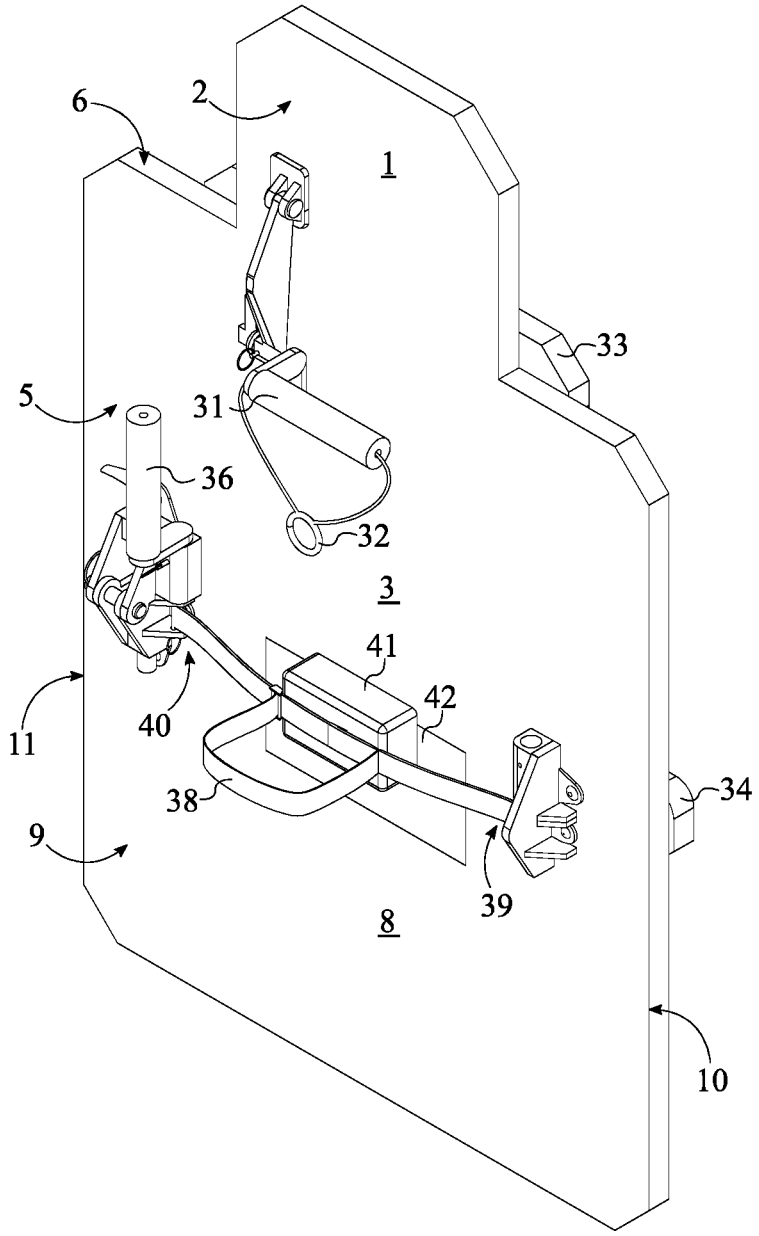
FIG. 8 is a rear-perspective view of an embodiment of the present invention where the head plate, the upper torso plate, and the lower torso plate are directly mounted onto each other.
Figure 9:
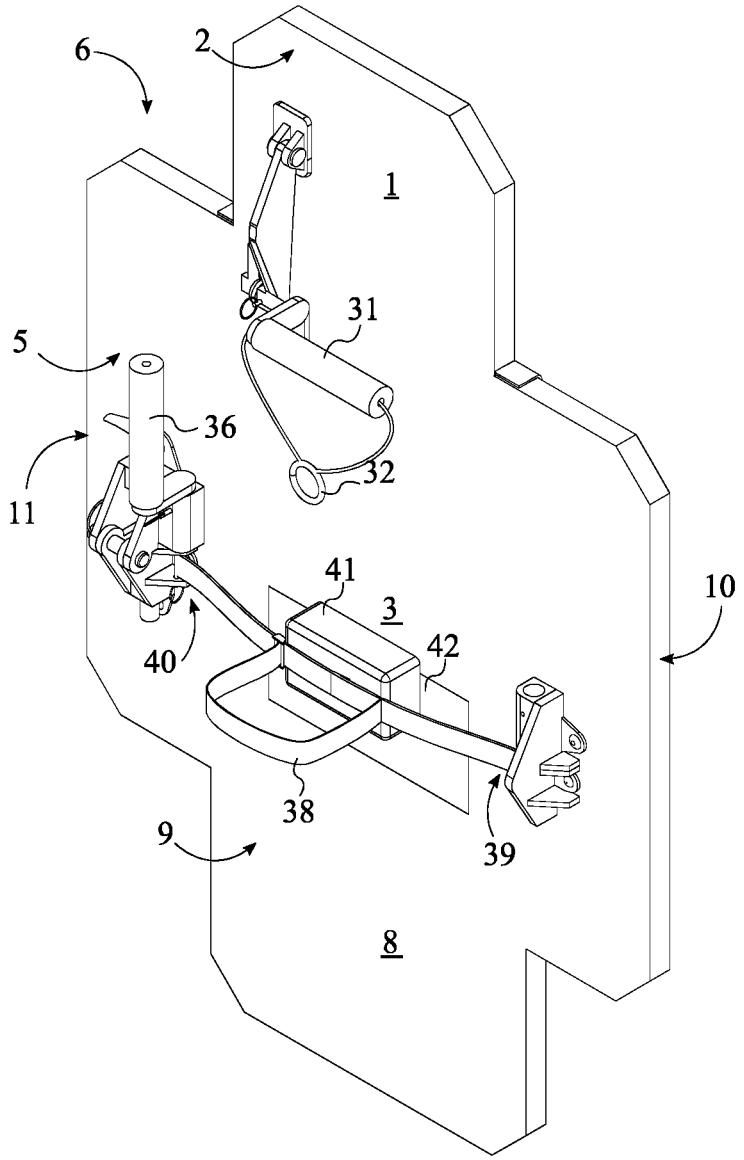
FIG. 9 is a rear-perspective view of an embodiment of the present invention where the lower torso plate is shaped to improve maneuverability.

Referring to FIG. 8 and FIG. 9, the head plate 1 is laterally mounted onto the upper torso plate 3 so that the head plate 1 is retained in a position that facilitates protecting the user's head. Similarly, the lower torso plate 8 is laterally mounted onto the upper torso plate 3 so that the lower torso plate 8 is retained in a position that facilitates protecting the lower portion of the user's body. Thus, the head plate 1, the upper torso plate 3, and the lower torso plate 8 are fixed to each other, such that a rigid shield is formed. Some embodiments feature a shield where the head plate 1, the upper torso plate 3, and the lower torso plate 8 may become permanently affixed to each other. These embodiments enable the user to deploy the present invention to erect a permanent structure.

Referring to FIG. 1 and FIG. 2, the upper lock-and-release hinge joint 12 mechanically couples the head plate 1 to the upper torso plate 3. Additionally, the upper lock-and-release hinge joint 12 allows the head plate 1 and the upper torso plate 3 to rotate relative to each other as well as detach from each other. In particular, the head plate 1 is pivotably attached to the upper torso plate 3 by the upper lock-and-release hinge joint 12. Similarly, the lower lock-and-release hinge joint 23 mechanically couples the upper torso plate 3 to the lower torso plate 8. The upper torso plate 3 and the lower torso plate 8 may rotate relative to each other, as well as detach from each other. Resultantly, the upper lock-and-release hinge joint 12 and the lower lock-and-release hinge joint 23 allow the head plate 1, the upper torso plate 3, and the lower torso plate 8 to lock into a coplanar configuration, a functional configuration to act as a rigid shield. Additionally, the head plate 1, the upper torso plate 3, and the lower torso plate 8 can be rotated and folded into a collapsed configuration. The collapsed configuration decreases the overall profile of the present invention, ideal for storage and transportation purposes.

Figure 3:
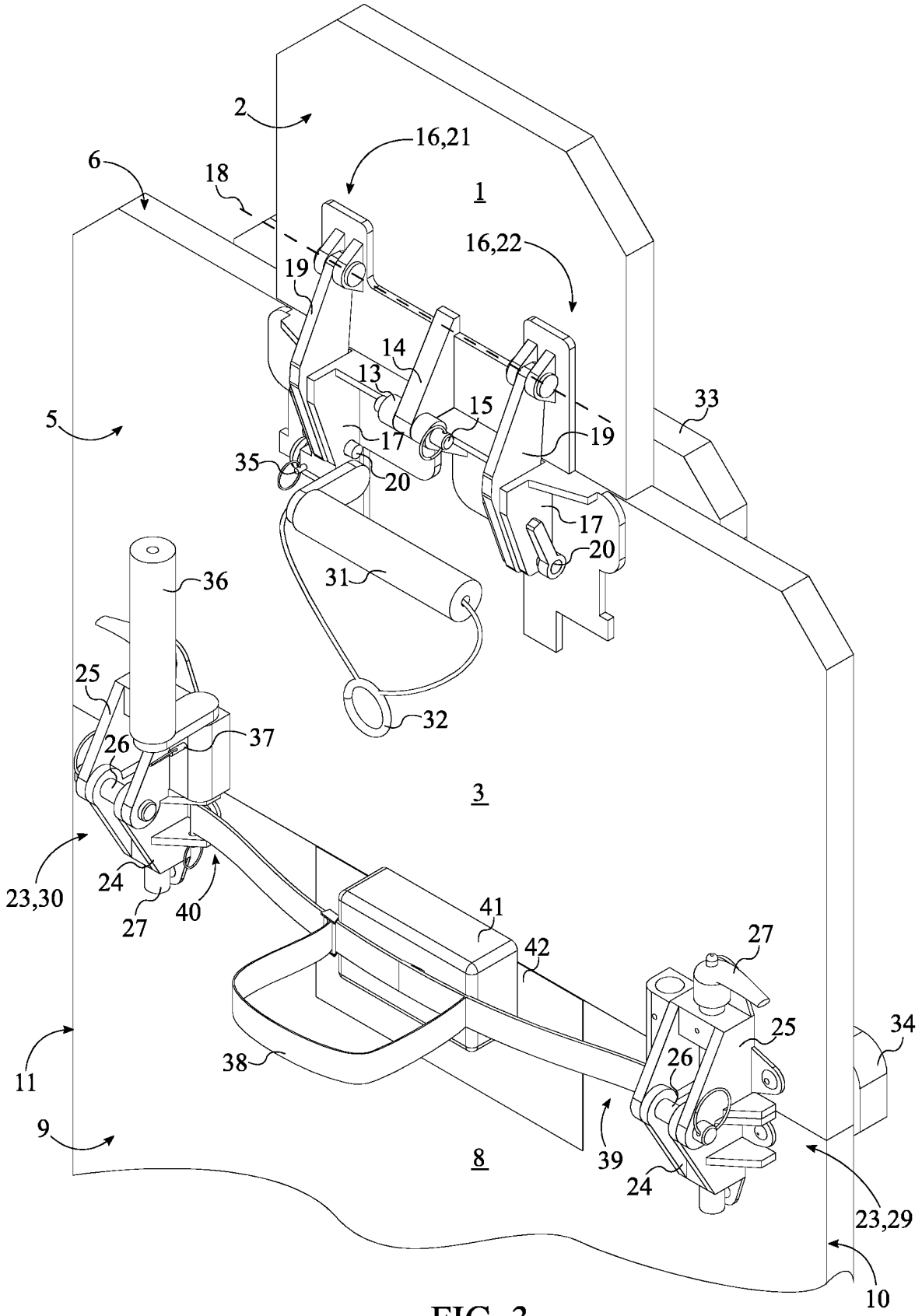
FIG. 3 is an enlarged rear-perspective view of the present invention.

The primary handle 31 acts as the grasping element for the present invention, allowing the user to hold and manipulate the present invention. The primary handle 31 is an elongated rod that is sized to be held within the user's hand. Referring to FIG. 3, the primary handle 31 is mounted to a rear surface 5 of the upper torso plate 3, adjacent to the upper lock-and-release hinge joint 12. In the preferred embodiment of the present invention, the primary handle 31 may be mounted to the upper torso plate 3 at different points for various uses. The strap-mounting fastener 32 allows the present invention to mount to a plate carrier or a similar article being worn by the user. In one embodiment of the present invention, the strap-mounting fastener 32 is a ring that is centrally tethered to the rear surface 5 of the upper torso plate 3 by one or more cords. Resultantly, the user is protected by the present invention with both of his or her hands free. The strap-mounting fastener 32 is centrally positioned to a top edge 6 of the upper torso plate 3 and is tethered to the rear surface 5 of the upper torso plate 3, adjacent to the head plate 1. This positioning centers the strap-mounting fastener 32 relative to the head plate 1, the upper torso plate 3, and the lower torso plate 8 such that the mounting point is coincident with a sagittal plane of the present invention. When mounted, the weight of the present invention is symmetrically supported, ensuring that the present invention is held in a vertical orientation with the head plate 1 above the lower torso plate 8. In one embodiment of the present invention, the strap-mounting fastener 32 is a ring that is tethered to the rear surface 5 of the upper torso plate 3 such that any hook or clasp may be easily locked or coupled.

Referring to FIG. 2 and FIG. 3, the present invention further comprises an upper joint plate 33 and a lower joint plate 34. The upper joint plate 33 and the lower joint plate 34 cover and protect the joints/intersecting portion in between the head plate 1, the upper torso plate 3, and the lower torso plate 8. For ballistic protection, the upper joint plate 33 and the lower joint plate 34 are both composed of ultra-high-molecular-weight polyethylene, or other materials with similar characteristics. The upper joint plate 33 protects the junction/joint in between the head plate 1 and the upper torso plate 3 as said junction/joint is a weak point for the present invention and would otherwise potentially allow bullets through. The upper joint plate 33 is an elongated plate sized at least to the width of the head plate 1, but may span the width of the upper torso plate 3 for optimal protection. The upper joint plate 33 is positioned parallel to the upper torso plate 3, adjacent to the head plate 1. More specifically, the upper joint plate 33 extends from the upper torso plate 3 to the head plate 1. The upper joint plate 33 is adjacently attached to a front surface other upper torso plate 3 and can be easily removed for transport purposes or to reconfigure the present invention. The lower joint plate 34 protects the junction/joint in between the upper torso plate 3 and the lower torso plate 8, as said junction/joint is a weak point for the present invention and would otherwise potentially allow bullets through. The lower joint plate 34 is an elongated plate sized to the width of the upper torso plate 3 and the lower torso plate 8. The lower joint plate 34 is positioned parallel to the upper torso plate 3, adjacent to the lower torso plate 8. More specifically, the lower joint plate 34 extends from the lower torso plate 8 to the upper torso plate 3. The lower joint plate 34 is adjacently attached the front surface 4 of the upper torso plate 3 and can be easily removed for transport purposes and to reconfigure the present invention. The configuration of the present invention as described above provides continuous ballistic protection from the head plate 1 to the lower torso plate 8, in particular, the silhouette shape and overall size of the present invention provides coverage for the head, neck, torso, arms and thighs of the user.

The upper lock-and-release hinge joint 12 pivotably attaches the head plate 1 and the upper torso plate 3 together. A variety of mechanisms may be used as the upper lock-and-release hinge joint 12. In the preferred embodiment of the present invention, the upper lock-and-release hinge joint 12 comprises a clevis 13, a tang 14, a first releasable pin 15, and an at least one locking mechanism 16. The clevis 13, the tang 14, and the first releasable pin 15 make up a clevis fastener assembly which allows two structures to rotate relative to each other. The clevis 13 is a U-shaped connector with a lateral hole that laterally traverses through both legs of the U-shaped connector. The clevis 13 is connected to the upper torso plate 3. In particular, the clevis 13 is perpendicularly connected to the rear surface 5 of the upper torso plate 3, adjacent to the top edge 6 of the upper torso plate 3. Additionally, the lateral hole of the clevis 13 is positioned parallel and offset to the top edge 6 of the upper torso plate 3. The tang 14 is an elongated extrusion shaped and sized to fit within the clevis 13. Complimentary to the clevis 13, the tang 14 includes a lateral hole. The tang 14 is positioned within the clevis 13 and is perpendicularly and terminally connected to a rear surface 2 of the head plate 1; wherein the lateral hole of the clevis 13 is coincidently positioned with the hole of the tang 14. The first releasable pin 15 mechanically couples the clevis 13 and the tang 14. The first releasable pin 15 is an elongated rod with a diameter approximately equal to the diameter of the lateral hole of the clevis 13 and the hole of the tang 14. The first releasable pin 15 is positioned parallel and offset to the top edge 6 of the upper torso plate 3, thus coinciding with the lateral hole of the clevis 13 and the hole of the tang 14. The clevis 13 is rotatably attached to the tang 14 by the first releasable pin 15. Resultantly, the head plate 1 is able to rotate relative to the upper torso plate 3 about the first releasable pin 15. The clevis fastener assembly is preferably centrally positioned along the top edge 6 of the upper torso plate 3 in order to yield a symmetrical weight distribution when the present invention is used in a vertical orientation. In order to release the clevis fastener assembly, the user simply disengages the first releasable pin 15 from the clevis 13 and the tang 14.

The locking mechanism 16 additionally secures the head plate 1 to the upper torso plate 3 and locks the head plate 1 at a 180-degree angle relative to the upper torso plate 3. The locking mechanism 16 comprises a plate-receiving mount 17, a locking plate 19, and a second releasable pin 20. The locking plate 19 is an elongated plate which engages to the plate-receiving mount 17 by the second releasable pin 20 in order to lock the head plate 1 to the upper torso plate 3 at a 180-degrees. The locking plate 19 is terminally and pivotably connected to the head plate 1. A rotation axis 18 of the locking plate 19 is oriented parallel to the top edge 6 of the upper torso plate 3 such that the locking plate 19 may be positioned overlapping a portion of the upper torso plate 3. The plate-receiving mount 17 is a U-shaped extrusion comprising two plates positioned parallel and offset to each other a distance approximately equal to the width of the locking plate 19. The plate-receiving mount 17 is terminally positioned to the locking plate 19, opposite to the head plate 1. Additionally, the plate-receiving mount 17 is perpendicularly connected to the rear surface 5 of the upper torso plate 3 to interlock with the locking plate 19. In the functional configuration, the locking plate 19 is attached to the plate-receiving mount 17 by the second releasable pin 20.

The second releasable pin 20 is an elongated rod which traverses through both the plate-receiving mount 17 and the interlocking plate 19 in order to mechanically secure the interlocking plate 19 to the plate-receiving mount 17. For this, the interlocking plate 19 and the plate-receiving mount 17 each comprise a corresponding hole that is sized to receive the second releasable pin 20. In order to lock the head plate 1 and the upper torso plate 3 at a 180-degree orientation to each other, the user rotates the locking plate 19 towards the upper torso plate 3 and positions the locking plate 19 within the plate-receiving mount 17. This action positions the bottom of the locking plate 19 adjacent and parallel to the rear surface 2 of the head plate 1 and the rear surface 5 of the upper torso plate 3. Next, the user inserts the second releasable pin 20 into the corresponding holes of the plate-receiving mount 17 and the locking plate 19, thus mechanically coupling the locking plate 19 to the plate-receiving mount 17. To unlock the locking mechanism 16, the user simply pulls out the second releasable pin 20. Additionally, for convenience purposes, the second releasable pin 20 is tethered to the rear surface 2 of the head plate 1.

Figure 4:
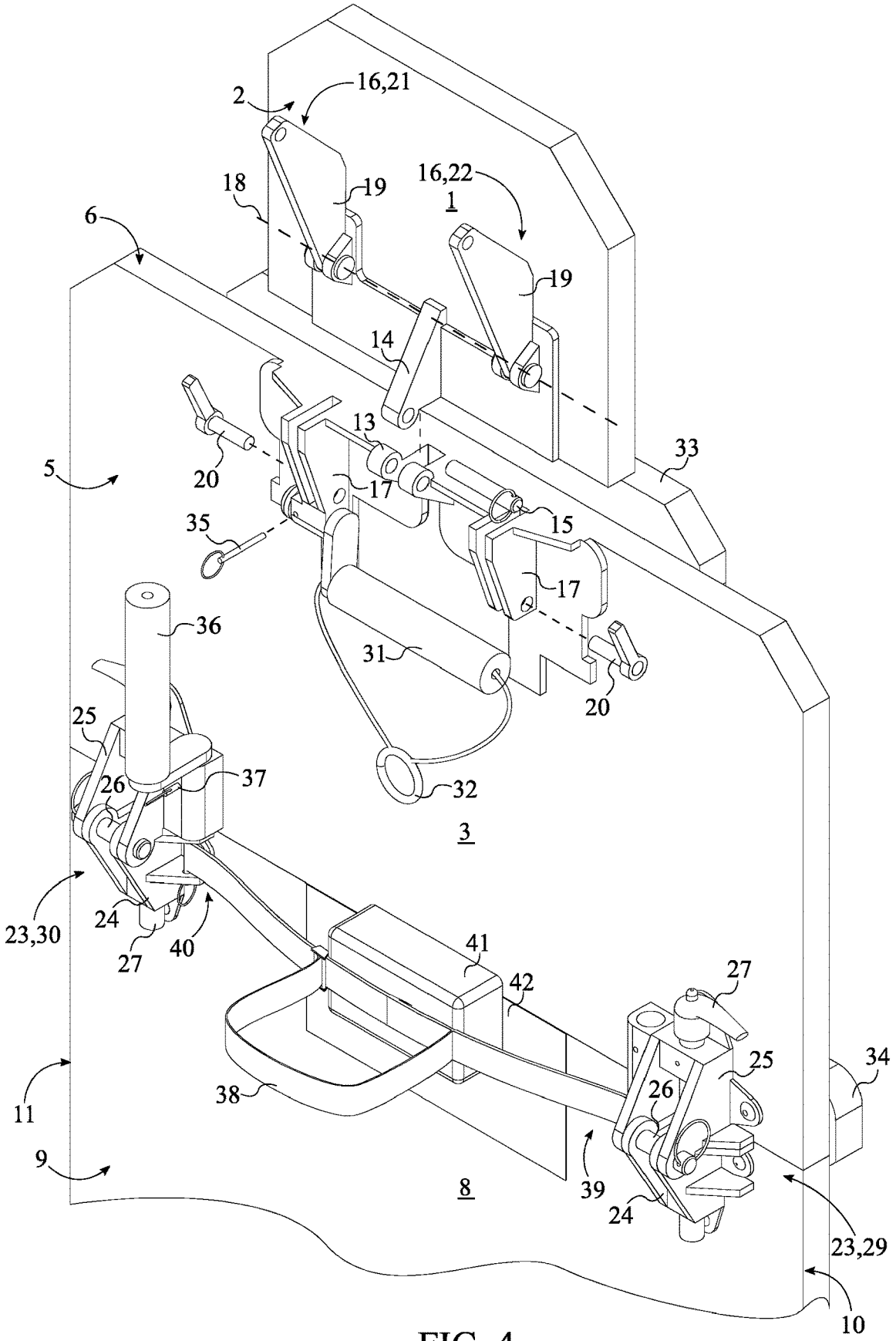
FIG. 4 is an enlarged and partially exploded view of the present invention.

Referring to FIG. 3 and FIG. 4, the primary handle 31 is mounted to the upper torso plate 3 by being coupled to a portion of the plate-receiving mount 17 by a third releasable pin 35. In particular, the primary handle 31 is positioned parallel and offset to the top edge 6 of the upper torso plate 3. Additionally, the primary handle 31 is positioned adjacent to the plate-receiving mount 17. The primary handle 31 is attached to the plate-receiving mount 17 by the third releasable pin 35. In one embodiment, the primary handle 31 is rotatably coupled to the plate-receiving mount 17 and is secured by the third releasable pin 35. For the collapsed configuration, this allows the user to remove the third releasable pin 35 and collapse the primary handle 31 directly against the rear surface 5 of the upper torso plate 3. The third releasable pin 35 is also preferably tethered to the primary handle 31. The primary handle 31 is used to tether the strap-mounting fastener 32 to the upper torso plate 3. In particular, the strap-mounting fastener 32 is centrally tethered to the primary handle 31. For symmetrical design, the strap-mounting fastener 32 is tethered to both ends of the primary handle 31.

Referring to FIG. 4, in the preferred embodiment of the present invention, the at least one locking mechanism 16 comprises a first locking mechanism 21 and a second locking mechanism 22 for symmetrical weight distribution and for symmetrical support. In particular, the first locking mechanism 21 and the second locking mechanism 22 are positioned along the top edge 6 of the upper torso plate 3. Additionally, the first locking mechanism 21 and the second locking mechanism 22 are positioned opposite to each other, across the head plate 1. The first locking mechanism 21 and the second locking mechanism 22 ensure that the head plate 1 does not accidentally collapse during operations even under extreme stress and force.

Figure 5:
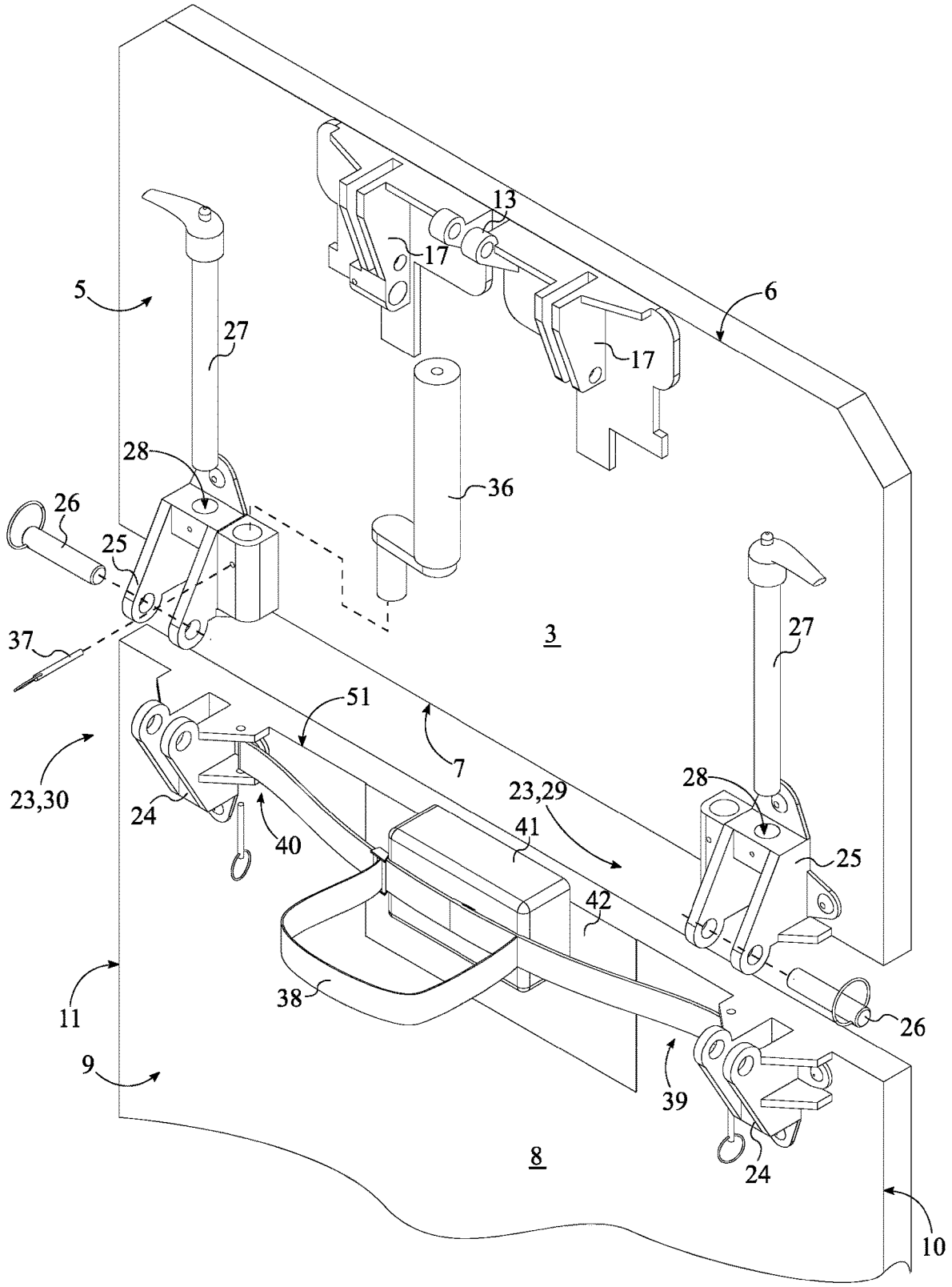
FIG. 5 is an enlarged and partially exploded view of the present invention with the head plate, the upper joint plate, the lower joint plate, the primary handle, and parts of the upper lock-and-release hinge joint being omitted.

Referring to FIG. 5, the lower lock-and-release hinge joint 23 comprises a male clevis mount 24, a female clevis mount 25, a fourth releasable pin 26, a fifth releasable pin 27, and a locking channel 28. The male clevis mount 24, the female clevis mount 25, and the fourth releasable pin 26 make up a pivot joint which allows the upper torso plate 3 and the lower torso plate 8 to rotate relative to each other about the fourth releasable pin 26. The fifth releasable pin 27 and the locking channel 28 lock the upper torso plate 3 and the lower torso plate 8 at a 180-degree orientation relative to each other. The male clevis mount 24 and the female clevis mount 25 are each a U-shaped connector. More specifically, the inner width of the female clevis mount 25 is greater than an outer width of the male clevis mount 24 such that the male clevis mount 24 may fit within the female clevis mount 25. The female clevis mount 25 and the male clevis mount 24 each include a corresponding lateral hole. The female clevis mount 25 is adjacently connected to the rear surface 5 of the upper torso plate 3; in particular, the female clevis mount 25 is positioned adjacent to a bottom edge 7 of the upper torso plate 3. The male clevis mount 24 is positioned within the female clevis mount 25 and is connected to a rear surface 9 of the lower torso plate 8. The fourth releasable pin 26 is an elongated rod which mechanically couples the male clevis mount 24 to the female clevis mount 25 and acts as the rotation axis for the second lock-and-release hinge joint. In particular, the fourth releasable pin 26 is oriented parallel to the bottom edge 7 of the upper torso plate 3 and traverses through the corresponding holes of the male clevis mount 24 and the female clevis mount 25. Resultantly, the male clevis mount 24 is rotatably attached to the female clevis mount 25 by the fourth releasable pin 26. It is preferred that the fourth releasable pin 26 is tethered to either the male clevis mount 24 or the rear surface 9 of the lower torso plate 8.

The fifth releasable pin 27 is an elongated rod which engages within the locking channel 28 in order to lock the upper torso plate 3 to the lower torso plate 8 in a 180-degree orientation. The locking channel 28 is oriented perpendicular to the bottom edge 7 of the upper torso plate 3 and is sized to receive the fifth releasable pin 27. Additionally, the locking channel 28 is positioned in between the rear surface 9 of the lower torso plate 8 and the fourth releasable pin 26. The locking channel 28 traverses through both the female clevis mount 25 and the male clevis mount 24. The fifth releasable pin 27 is mechanically engaged within the locking channel 28 to mechanically couple the male clevis mount 24 and the female clevis mount 25, thus preventing the female clevis mount 25 and the male clevis mount 24 from rotating relative to each other. It is preferred that the fifth releasable pin 27 is a quick-release pin that is tethered to either the female clevis mount 25 or the rear surface 9 of the lower torso plate 8.

Referring to FIG. 5, the at least one lower lock-and-release hinge joint 23 preferably comprises a first lower joint 29 and a second lower joint 30 to yield a symmetrical structure about a sagittal plane of the present invention. The first lower joint 29 and the second lower joint 30 are positioned along the bottom edge 7 of the upper torso plate 3. Additionally, the first lower joint 29 and the second lower joint 30 are positioned opposite to each other across the upper torso plate 3. In particular, the first lower joint 29 is positioned adjacent to a first lateral edge 10 of the lower torso plate 8 and the second lower joint 30 is positioned adjacent to a second lateral edge 11 of the lower torso plate 8. This distributes the weight of the present invention symmetrically about the sagittal plane.

Figure 6:
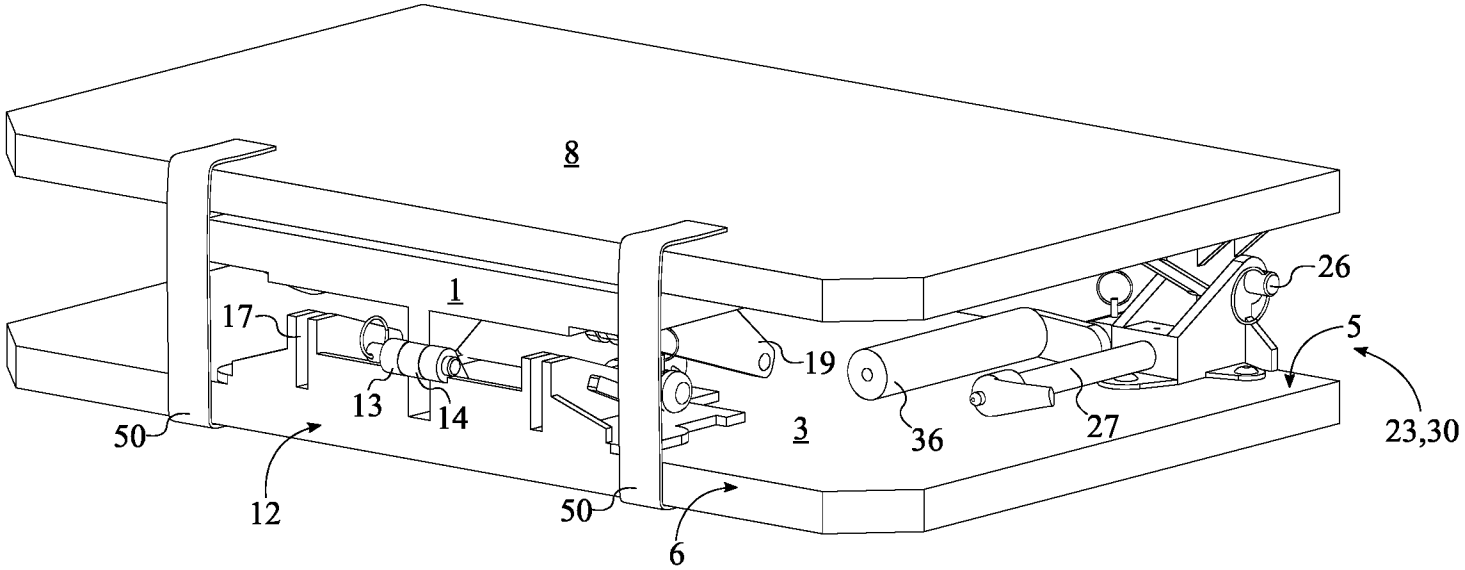
FIG. 6 is a perspective view of the present invention in a collapsed configuration.
Figure 7:
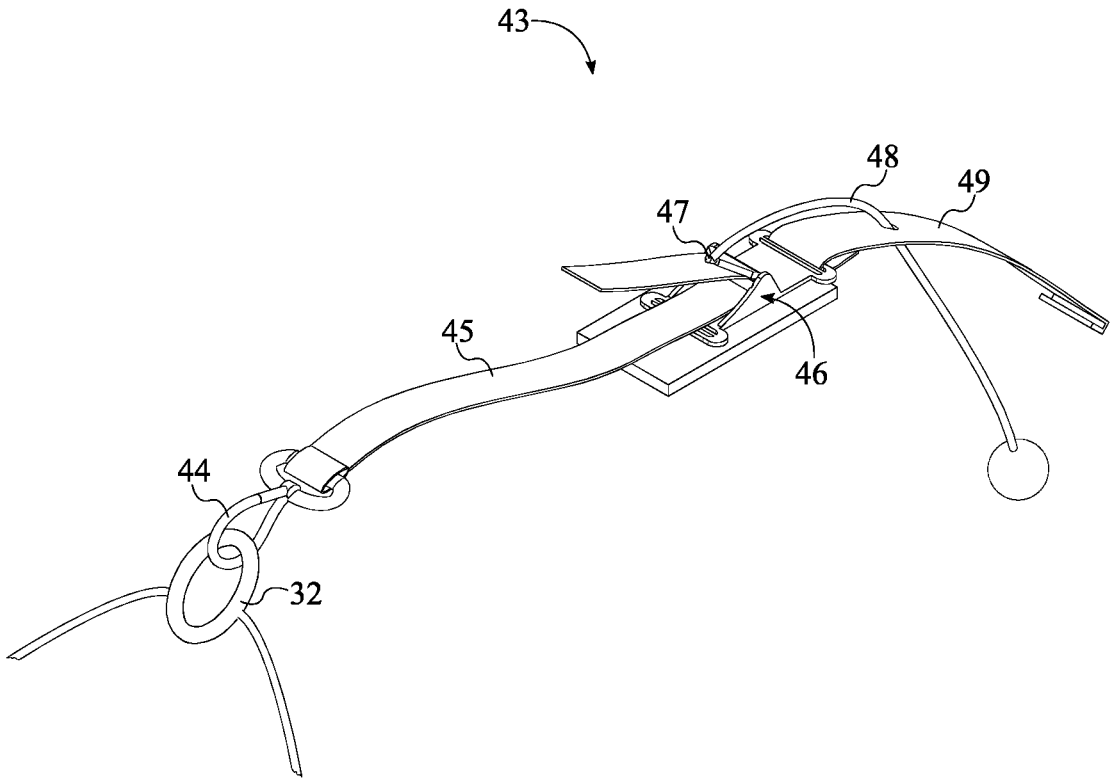
FIG. 7 is a perspective view of the adjustable sling connected to the strap mounting fastener.

Referring to FIG. 5 through FIG. 7, the present invention may further comprise a secondary handle 36, a sixth releasable pin 37, an adjustable forearm strap 38, a second fastening mechanism 42, a forearm padding 41, an adjustable sling 43, and an at least one locking strap 50. The secondary handle 36 is an elongated rod which provides the user with an additional grasping/holding point for the present invention. The secondary handle 36 is positioned parallel and offset to a rear surface 5 of the upper torso plate 3. Additionally, the secondary handle 36 is oriented perpendicular to the top edge 6 of the upper torso plate 3, and consequently oriented perpendicular to the primary handle 31. The secondary handle 36 allows the user to hold the present invention with his or her arm being oriented parallel to the top edge 6 of the upper torso plate 3. Additionally, the secondary handle 36 may be used to assist the user in manipulating the position and orientation of the present invention. The secondary handle 36 is attached to the female clevis mount 25 of the lower lock-and-release hinge joint 23 by the sixth releasable pin 37, thus allowing the user to mount the secondary handle 36 adjacent to either the first lateral edge of the upper torso or the second lateral edge of the upper torso. In alternative embodiments of the present invention, the secondary handle 36 may be attached through a variety of alternative fasteners including, but not limiting to, hook-and-loop fasteners, bolts, screws, and other similar mechanisms. Additionally, the secondary handle 36 may be attached to alternative locations on the upper torso plate 3, the lower torso plate 8, and the head plate 1 depending on the needs and preferences of the user. Further, the secondary handle 36, and the primary handle 31, are designed to me interchangeable and reconfigurable. In some embodiments, the secondary handle 36 and the primary handle 31 may be attached to the female clevis mount on either side of the upper torso plate 3 or inserted into the locking channel 28 when the upper torso plate 3 and the lower torso plate 8 are disconnected. Thus, enabling the present invention to be used as two separate shields. Additionality, this functionality increases the maneuverability of the present invention. The present invention may also be utilized in a conventional "hand-carry" manner, wherein the user may employ the present invention with one arm (carry-arm). To do so, the user may grip the primary handle 31 with the hand of their carry-arm and hold the present invention up to their body for protection. To aid in this, the adjustable forearm strap 38 may be utilized to add another firm point of contact between the user and the present invention. The adjustable forearm strap 38 is an elongated strap with a central loop designed to receive the forearm of the user. The adjustable forearm strap 38 is positioned adjacent to the rear surface 9 of the lower torso plate 8, around the waist line of the user. Additionally, the adjustable forearm strap 38 is oriented parallel top a top edge 51 of the lower torso plate 8, extending the adjustable forearm strap 38 along the width of the lower torso plate 8. A first end 39 of the adjustable forearm strap 38 is attached to the lower torso plate 8, adjacent to a first lateral edge 10 of the lower torso plate 8. Similarly, a second end 40 of the adjustable forearm strap 38 is attached to the lower torso plate 8, adjacent to a second lateral edge 11 of the lower torso plate 8. In the preferred embodiment of the present invention, the first end 39 of the adjustable forearm strap 38 is terminally and laterally attached to the male clevis mount 24 of the first lower joint 29 by a seventh releasable pin. Similarly, the second end 40 of the adjustable forearm strap 38 is terminally and laterally attached to the male clevis mount 24 of the second lower joint 30 by an eighth releasable pin. A plurality of strap buckles is distributed along the adjustable forearm strap 38 to provide the user with customization options. The plurality of strap buckles allows the user to vary the positioning of the adjustable forearm strap 38 relative to the lower torso plate 8 and to vary the diameter of the central loop. To utilize the adjustable forearm strap 38, the user positions his or her forearm within the central loop of the adjustable forearm strap 38, tightens the adjustable forearm strap 38 to his or her comfort level with the plurality of strap buckles, and grabs the primary handle 31 with the same hand. This yields two firm points of contact between the user and the present invention, thus increasing the ease with which the user can manage the positioning, orientation, and weight of the present invention.

For additional forearm support, the forearm padding 41 and the second fastening mechanism 42 may be utilized. The forearm padding 41 is a rectangular extrusion composed of a soft and padded material. The forearm padding 41 provides spacing between the rear surface 9 of the lower torso plate 8 and the user's forearm. Additionally, the forearm padding 41 absorbs potential forces from ballistic impacts to prevent injury to the user's arm. The forearm padding 41 is positioned in between the adjustable forearm strap 38 and the rear surface 9 of the lower torso plate 8, preferably directly adjacent to the central loop of the adjustable forearm strap 38. Additionally, the forearm padding 41 is adjacently attached to the adjustable forearm strap 38. To ensure that the adjustable forearm strap 38 and the forearm padding 41 do not slide relative to the lower torso plate 8, the second fastening mechanism 42 is used. The second fastening mechanism 42 is adjacently attached to the forearm padding 41, opposite to the adjustable forearm strap 38. Additionally, the second fastening mechanism 42 is adjacently connected to the rear surface 9 of the lower torso plate 8. Resultantly, the forearm padding 41 is attached to the rear surface 9 of the lower torso plate 8 by the second fastening mechanism 42. A variety of mechanisms may be used as the second fastening mechanism 42, but the preferred mechanism is hook-and-loop fasteners. The hook-and-loop fasteners allow the user to easily alter the positioning of the forearm padding 41 on the rear surface 9 of the lower torso plate 8.

Referring to FIG. 6 and FIG. 7, the adjustable sling 43 allows the user to tether the present invention to a plate carrier or another similar article worn by the user. Resultantly, the adjustable sling 43 helps reduce the fatigue on one or both arms of the user by transferring some, or all of the weight to a plate carrier. In the preferred embodiment of the present invention, the adjustable sling 43 comprises a hook clasp 44, a main strap 45, a cam buckle 46, a release cord 48, and an attachment strap 49. The hook clasp 44 couples the adjustable sling 43 to the strap-mounting fastener 32 and is terminally connected to the main strap 45. In particular the hook clasp 44 is mechanically engaged with the strap-mounting fastener 32. The main strap 45 engages the cam buckle 46 in order to allow the user to vary the length between the cam buckle 46 and the hook clasp 44, i.e. changing the length of the main strap 45. More specifically, the main strap 45 and the attachment strap 49 are positioned opposite to each other, across the cam buckle 46. Additionally, the main strap 45 is positioned tensionably through the cam buckle 46. The cam buckle 46 may allow the main strap 45 to be pulled freely in one direction but not the other; this may be accomplished through a self-locking design. This ensures that the weight of the upper torso plate 3 and the additional attached components do not permit the main strap 45 to move within the cam buckle 46, thereby locking the main strap 45 into a specific and desired length. The attachment strap 49 is terminally connected to the cam buckle 46 and is used to anchor the adjustable sling 43 to a plate carrier or other similar article worn by the user, most usually to the rear portion of said article, on the back of the user. The cam buckle 46 and the attachment strap 49 are designed to be positioned over the user's shoulder in order to weigh the present invention directly onto the user's shoulder(s). The release cord 48 is tethered to a release lever 47 of the cam buckle 46 and provides the user an easy means for releasing the cam buckle 46. When mounted to a plate carrier, the release cord 48 may be routed towards the rear of the plate carrier through a grommet located in the attachment strap 49, positioning the release cord 48 at an easy access area near the user's hip. The release cord 48 may also be weighted at the free end to keep the release cord 48 taut for easier blind grabbing. In one embodiment of the present invention, a positioning strap may be used to align the adjustable sling 43 over a shoulder strap of a plate carrier. The positioning strap is attached to the cam buckle 46 and includes a fastening mechanism 42, such as hook-and-loops, which attaches the positioning strap to the shoulder strap of a plate carrier.

The adjustable sling 43 may be used in conjunction with a support hook, wherein the adjustable sling 43 supports from the upper torso plate 3 and the support hook provides support from bottom of the lower torso plate 8. The support hook is a U-shaped extrusion sized to receive the lower torso plate 8. The support hook attaches to the user around the waist area and allows the lower torso plate 8 to rest on top of the support hook. The support hook allows the user to rest during periods of inactivity. The support hook may also comprise one or more PALS (Pouch Attachment Ladder System)-compatible hangers which may enable support hook to be attached to various articles the user is wearing, such as a belt or a plate carrier, wherein the hangers may also comprise hanger straps, which may be used to secure the support hook to an attachment location.

As mentioned before, the present invention may be configured into the collapsed configuration and the functional configuration. In the collapsed configuration, the head plate 1, the upper torso plate 3, and the lower torso plate 8 are positioned parallel to each other. Resultantly, the head plate 1 is positioned in between the upper torso plate 3 and the lower torso plate 8. To position the present invention into the collapsed configuration, the user first releases the first locking mechanism 21 and the second locking mechanism 22 of the upper lock-and-release hinge joint 12. This is accomplished by sliding out the second releasable pin 20 of the first locking mechanism 21 and sliding out the second releasable pin 20 of the second locking mechanism 22; and, rotating the locking plate 19 of the first locking mechanism 21 and the locking plate 19 of the second locking mechanism 22 towards the head plate 1. Next, the user rotates the head plate 1 about the first releasable pin 15 until the head plate 1 is adjacent and parallel to the upper torso plate 3. Then, the user needs to unlock the first lower joint 29 and the second lower joint 30. This is accomplished by sliding out the fifth releasable pin 27 of the first lower joint 29 and the second lower joint 30 to allow the lower torso plate 8 to rotate relative to the upper torso plate 3. Next, the user rotates the lower torso plate 8 about the fourth releasable pin 26 of the first lower joint 29 and the fourth releasable pin 26 of the second lower joint 30 until the lower torso plate 8 is positioned parallel and adjacent to the head plate 1 as seen in FIG. 6. To secure the head plate 1, the upper torso plate 3, and the lower torso plate 8 in the aforementioned configuration, the locking strap 50 is used. The locking strap 50 is positioned opposite the lower lock-and-release hinge joint 23, across the upper torso plate 3 and the lower torso plate 8. To lock the collapsed configuration, the locking strap 50 is attached in between the upper torso plate 3 and the lower torso plate 8. In the preferred embodiment of the present invention, the locking strap 50 is attached to the upper torso plate 3 and the lower torso plate 8 through hook-and-loop fasteners. This allows for quick and easy attachment and detachment of the locking strap 50, although alternative means may be used. The collapsed configuration significantly reduces the overall profile of the present invention, thus allowing the user to easily transport or store the present invention. In one embodiment, backpack straps may be attached to the outer portions of the present invention when the present invention is configured into the collapsed configuration for transport purposes.

Referring to FIG. 1 and FIG. 2, the present invention may be positioned into the functional configuration, thus allowing the user to utilize the present invention as a ballistics shield. In the functional configuration, the head plate 1, the upper torso plate 3, and the lower torso plate 8 are positioned coplanar with each other. The present invention is secured in this configuration by engaging the first locking mechanism 21, the second locking mechanism 22, the first lower joint 29, and the second lower joint 30 as described above.

The upper lock-and-release hinge joint 12 and the lower lock-and-release hinge joint(s) 23 allow for the head plate 1 to detach from the upper torso plate 3 and for the lower torso plate 8 to detach from the upper torso plate 3. Resultantly, the head plate 1, the upper torso plate 3, and the lower torso plate 8 may be utilized by the user individually or combined together in alternative configurations to yield a partial ballistics shield. For example, the upper torso plate 3 may be utilized by itself. Another example, the upper torso plate 3 may be utilized with the head plate 1 only. In another example, the upper torso plate 3 may be utilized with the lower torso plate 8 only. These alternative configurations increase the versatility of the present invention, providing the user with protection for a variety of situations.

In an alternative embodiment, the present invention may further comprise a shield support hook. According to an exemplary embodiment, the shield support hook may be used to help support the weight of the present invention during a period of inactivity. The shield support hook may comprise a shield rest on which the upper torso plate 3 or the lower torso plate 8 may be placed upon for support, and it may also comprise one or more PALS (Pouch Attachment Ladder System)-compatible hangers which enable said shield support hook to be attached to various articles which the user may be wearing, such as a belt or a plate carrier; wherein the hangers may also comprise hanger straps, which may be used to secure the shield support hook to an attachment location.

In other embodiments, present invention may be comprised of two, four, or more primary armor plates and any number of joint armor plates. The aforementioned plates may be round, triangular, or any other shape or combination of shapes, and may be of various sizes and thicknesses, and may be coupled together in various other configurations with fasteners or by other means. In other embodiments of the present invention, the overall shape of the present invention may be other than coplanar, for example, the overall shape may be curved or contain sharp turns for additional protection or convenience. Additionally, asymmetrical designs may also be utilized in alternative designs of the present invention.

In alternative embodiments of the present invention, additional armor plates may be laterally connected through the first lower joint 29 and the second lower joint 30, wherein the fourth releasable pin 26 includes a channel running along the length of the fourth releasable pin 26. This allows the whole present invention to be mounted/attached to another structure in a latter fashion.

The construction and arrangement of the present invention as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

Although the invention has been explained in relation to its preferred embodiment, it is to be understood that many other possible modifications and variations can be made without departing from the spirit and scope of the invention as hereinafter claimed.

What is claimed is:

1. A modular, collapsible, and portable ballistic shield system comprises:

a head plate;

an upper torso plate;

a lower torso plate;

a primary handle;

a strap-mounting fastener;

the head plate being laterally mounted onto the upper torso plate;

the lower torso plate being laterally mounted onto the upper torso plate;

the head plate, the upper torso plate, and the lower torso plate being oriented parallel to each other;

the head plate and the lower torso plate being positioned opposite to each other across the upper torso plate;

the primary handle being mounted to a rear surface of the upper torso plate;

the primary handle being positioned offset from the head plate;

the strap-mounting fastener being centrally positioned to a top edge of the upper torso plate;

the strap-mounting fastener being tethered to the rear surface of the upper torso plate, adjacent to the head plate;

at least one upper lock-and-release hinge joint;

the head plate being pivotably attached to the upper torso plate by the upper lock-and-release hinge joint;

the primary handle being positioned adjacent to the upper lock-and-release hinge joint;

the upper lock-and-release hinge joint comprises a clevis, a tang, and a first releasable pin;

the clevis being perpendicularly connected to the rear surface of the upper torso plate, adjacent to the top edge of the upper torso plate;

the tang being positioned within the clevis;

the tang being perpendicularly and terminally connected to a rear surface of the head plate;

the first releasable pin being positioned parallel and offset to the top edge of the upper torso plate; and the clevis being rotatably attached to the tang by the first releasable pin.

2. The modular, collapsible, and portable ballistic shield system as claimed in claim 1 comprises:

an upper joint plate;

the upper joint plate being positioned parallel to the upper torso plate, adjacent to the head plate;

the upper joint plate extending from the upper torso plate to the head plate; and the upper joint plate being adjacently attached to a front surface of the upper torso plate.

3. The modular, collapsible, and portable ballistic shield system as claimed in claim 1 comprises:

a lower joint plate;

the lower joint plate being positioned parallel to the upper torso plate, adjacent to the lower torso plate;

the lower joint plate extending from the lower torso plate to the upper torso plate; and the lower joint plate being adjacently attached to a front surface of the upper torso plate.

4. The modular, collapsible, and portable ballistic shield system as claimed in claim 1 comprises:

the upper lock-and-release hinge joint comprises an at least one locking mechanism;

the locking mechanism comprises a plate-receiving mount, a locking plate, and a second releasable pin;

the locking plate being terminally and pivotably connected to the head plate;

a rotation axis of the locking plate being oriented parallel to the top edge of the upper torso plate;

the plate-receiving mount being terminally positioned to the locking plate, opposite the head plate;

the plate-receiving mount being perpendicularly connected to the rear surface of the upper torso plate; and the locking plate being attached to the plate-receiving mount by the second releasable pin.

5. The modular, collapsible, and portable ballistic shield system as claimed in claim 4 comprises:

the at least one locking mechanism comprises a first locking mechanism and a second locking mechanism;

the first locking mechanism and the second locking mechanism being positioned along the top edge of the upper torso plate; and the first locking mechanism and the second locking mechanism being positioned opposite to each other, across the head plate.

6. The modular, collapsible, and portable ballistic shield system as claimed in claim 1 comprises:

a third releasable pin;

the primary handle being positioned parallel and offset to the top edge of the upper torso plate;

the primary handle being positioned adjacent to a plate-receiving mount of the upper lock-and-release hinge joint;

the primary handle being attached to the plate-receiving mount by the third releasable pin; and the strap-mounting fastener being centrally tethered to the primary handle.

7. The modular, collapsible, and portable ballistic shield system as claimed in claim 1 comprises:

at least one lower lock-and-release hinge joint; and the lower torso plate being pivotably attached to the upper torso plate by the lower lock-and-release hinge joint.

8. The modular, collapsible, and portable ballistic shield system as claimed in claim 7 comprises:

the lower lock-and-release hinge joint comprises a male clevis mount, a female clevis mount, a fourth releasable pin, a fifth releasable pin, and a locking channel;

the female clevis mount being adjacently connected to the rear surface of the upper torso plate;

the female clevis mount being positioned adjacent to a bottom edge of the upper torso plate;

the male clevis mount being positioned within the female clevis mount;

the male clevis mount being connected to a rear surface of the lower torso plate;

the fourth releasable pin being oriented parallel to the bottom edge of the upper torso plate;

the male clevis mount being rotatably attached to the female clevis mount by the fourth releasable pin;

the locking channel being oriented perpendicular to the bottom edge of the upper torso plate;

the locking channel is positioned in between the rear surface of the lower torso plate and the fourth releasable pin;

the locking channel traversing through the female clevis mount and the male clevis mount; and the fifth releasable pin being mechanically engaged within the locking channel.

9. The modular, collapsible, and portable ballistic shield system as claimed in claim 8 comprises:

the at least one lower lock-and-release hinge joint comprises a first lower joint and a second lower joint;

the first lower joint and the second lower joint being positioned along the bottom edge of the upper torso plate; and the first lower joint and the second lower joint being positioned opposite to each other across the upper torso plate.

10. The modular, collapsible, and portable ballistic shield system as claimed in claim 7 comprises:

a secondary handle;

a sixth releasable pin;

the secondary handle being positioned parallel and offset to the rear surface of the upper torso plate;

the secondary handle being oriented perpendicular to the top edge of the upper torso plate; and the secondary handle being attached to a female clevis mount of the lower lock-and-release hinge joint by the sixth releasable pin.

11. The modular, collapsible, and portable ballistic shield system as claimed in claim 7 comprises:

an at least one locking strap;

wherein the head plate, the upper torso plate, and the lower torso plate being configured into a collapsed configuration;

the head plate, the upper torso plate, and the lower torso plate being positioned parallel to each other;

the head plate being positioned in between the upper torso plate and the lower torso plate;

the locking strap being positioned opposite the lower lock-and-release hinge joint, across the upper torso plate and the lower torso plate; and the locking strap being attached in between the upper torso plate and the lower torso plate.

12. The modular, collapsible, and portable ballistic shield system as claimed in claim 1 comprises:

an adjustable forearm strap;

the adjustable forearm strap being positioned adjacent to the rear surface of the lower torso plate;

the adjustable forearm strap being oriented parallel to a top edge of the lower torso plate;

a first end of the adjustable forearm strap being attached to the lower torso plate, adjacent to a first lateral edge of the lower torso plate; and a second end of the adjustable forearm strap being attached to the lower torso plate, adjacent to a second lateral edge of the lower torso plate.

13. The modular, collapsible, and portable ballistic shield system as claimed in claim 12 comprises:

a forearm padding;

a fastening mechanism;

the forearm padding being positioned in between the adjustable forearm strap and a rear surface of the lower torso plate;

the fastening mechanism being adjacently attached to the forearm padding, opposite the adjustable forearm strap;

the fastening mechanism being adjacently connected to the rear surface of the lower torso plate; and the forearm padding being attached to the rear surface of the lower torso plate by the fastening mechanism.

14. The modular, collapsible, and portable ballistic shield system as claimed in claim 1 comprises:

an adjustable sling;

the adjustable sling comprises a hook clasp, a main strap, a cam buckle, a release cord, and an attachment strap;

the main strap and the attachment strap being positioned opposite to each other, across the cam buckle;

the main strap being positioned tensionably through the cam buckle;

the attachment strap being terminally connected to the cam buckle;

the hook clasp being terminally attached to the main strap;

the release cord being tethered to a release lever of the cam buckle; and the hook clasp being mechanically engaged with the strap-mounting fastener.

15. The modular, collapsible, and portable ballistic shield system as claimed in claim 1 comprises:

wherein the head plate, the upper torso plate, and the lower torso plate being configured into a functional configuration; and the head plate, the upper torso plate, and the lower torso plate being positioned coplanar with each other.

* * * * *